United States Patent [19]

Maizland

[11] 4,340,884

[45] Jul. 20, 1982

[54] INTRUSION ALARM

[76] Inventor: Ronald E. Maizland, 12909 Harding, Silmar, Calif. 91342

[21] Appl. No.: 152,299

[22] Filed: May 22, 1980

[51] Int. Cl.[3] ..... G08B 13/12

[52] U.S. Cl. ..... 340/548; 200/61.62; 200/61.93; 340/572

[58] Field of Search ..... 340/548, 546, 568, 572; 200/61.93, 61.62, 61.81, 61.18

[56] References Cited

U.S. PATENT DOCUMENTS

| | | | |
|---|---|---|---|
| 882,570 | 3/1908 | Liaci | 340/548 X |
| 914,173 | 3/1909 | Norpoth | 340/548 |
| 2,780,689 | 2/1957 | La Cavera | 340/548 X |
| 2,897,307 | 7/1959 | Johnston | 200/61.93 X |
| 3,175,207 | 3/1965 | Hewitt, Jr. | 340/546 X |
| 3,450,852 | 6/1969 | Rhodes | 340/548 X |
| 3,887,909 | 6/1975 | Beiswenger et al. | 340/548 X |
| 4,271,405 | 6/1981 | Kitterman | 340/548 X |

FOREIGN PATENT DOCUMENTS

| | | | |
|---|---|---|---|
| 665750 | 1/1952 | United Kingdom | 340/548 |
| 2016777 | 9/1979 | United Kingdom | 340/548 |

*Primary Examiner*—John W. Caldwell, Sr.
*Assistant Examiner*—Joseph E. Nowicki
*Attorney, Agent, or Firm*—Donald D. Mon

[57] ABSTRACT

An intrusion alarm comprised of a retractible cord having a releasable member attached to one end of the cord. The releasable member can be held at one side of an entry way such as a door way, holding the cord extended. A retractor mounted at the other side of the entry way so as to retract the cord when the releasable member is released, such as by the opening of a door. The alarm includes a power source and a signal, these being operatively connected to sound an alarm when the releasable member is released. The releasable member may be such as a magnet, and it can also be used as a switch to connect the power supply to the signal.

10 Claims, 6 Drawing Figures

INTRUSION ALARM

FIELD OF THE INVENTION

This invention relates to alarm devices and, more particularly, relates to an intrusion type alarm which can be made readily portable, and is adaptable to the protection of many types of entries and areas.

BACKGROUND OF THE INVENTION

There are many types of intrusion or burglar alarms presently available in the art. However, most of these devices are electronic in nature and are complicated, and costly. For example, such devices frequently involve the disturbance of sound or light patterns which protect an entry or area, and sound an alarm when they are disturbed. Other less exotic devices take the form of conductive stripes or contacts which are broken, or opened when the entry way is opened, thus setting off an alarm. These devices are expensive to install. Most of them are not readily portable.

BRIEF DESCRIPTION OF THE INVENTION

In the present invention, the intrusion device is comprised of a retractible cord adapted to be extended to span an entry way. Releasible means is provided for holding the cord in an extended position across the entry way. When the releasible means is released, the cord is released and retracted by a retractor, such as a spring-wound reel. Retraction of the cord connects a power source to an alarm device to set off the alarm indicating that there has been an unauthorized entry.

It is an object of this invention to provide an inexpensive, reliable and readily portable intrusion alarm.

The releasible means is preferably in the form of a magnet attached to the end of the cord which can hold the cord across the entry way by magnetic attachment to the frame of the entry way (if made of magnetic material) or to a plate of magnetic material attached to a surface on one side of the entry way. The alarm device and power source will be attached to a surface of the building on the other side of the entry way. The device is suitable for use in any type of entry way, including sliding or swinging doors or windows. All that is necessary is that the releasible means in some fashion be released from the entry way allowing the cord to retract and set off the alarm.

The above and other features of this invention will be fully understood from the following detailed description and the accompanying drawings, in which:

DETAILED DESCRIPTION OF THE INVENTION

Figure 1:
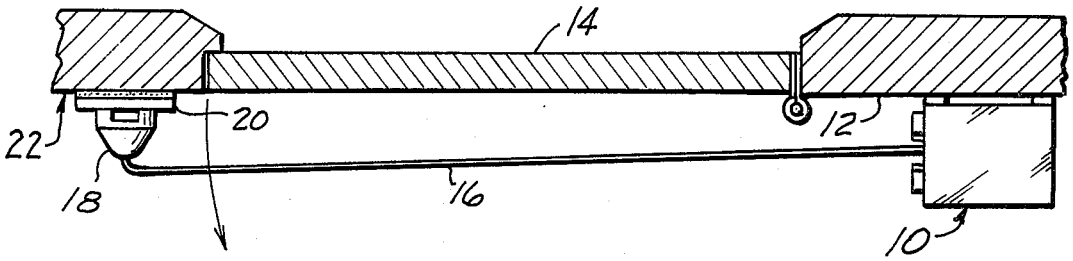
FIG. 1 is a partial section view illustrating the installation and operation of the intrusion alarm.

The intrusion alarm 10 of the present invention is shown attached to a surface 12 of a building having an entry 14 which may be a door or window. The intrusion alarm includes a retractible cord 16. Releasible means 18 in the form of a plug-shaped magnet is attached to the end of the cord. The cord 16 is shown held across entry way 14 by means of the magnetic attraction between the plug 18 and a metal plate 20 (of magnetic material such as iron) attached to a surface 22 on the opposite side of the entry way 14 from surface 12. The plate is attached to surface 22 by a layer of pressure sensitive adhesive, and may be pulled off for re-use. Either the plug 18 or the plate 20 can be constructed of magnetic material with the other part, of course, being constructed of a metal which will be attached by a magnet. Preferably the plug 18 is magnetized so that if the surface 24 should be made of a magnetically attractive (magnetizable) material, the metal plate 20 need not be used. Thus, the disclosed releasible means does not necessarily include two parts. If the door frame or window frame is made of magnetizable material, only the magnet need be supplied.

Figure 3:
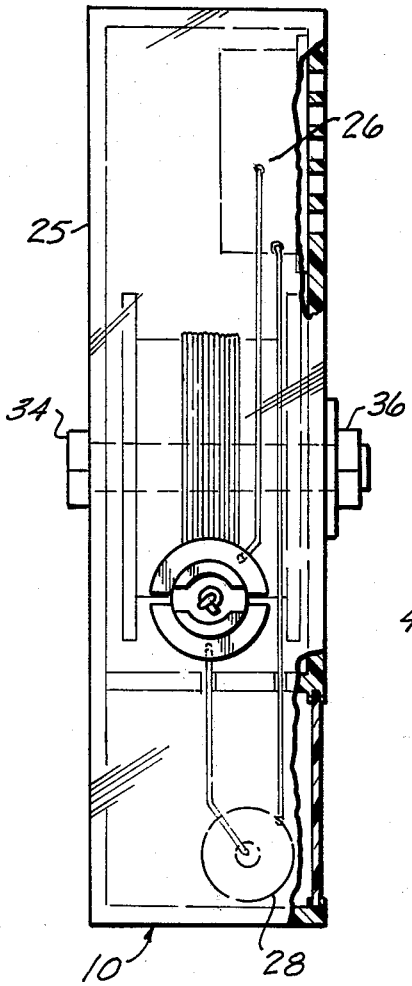
FIG. 3 is a side view of the intrusion alarm.
Figure 2:
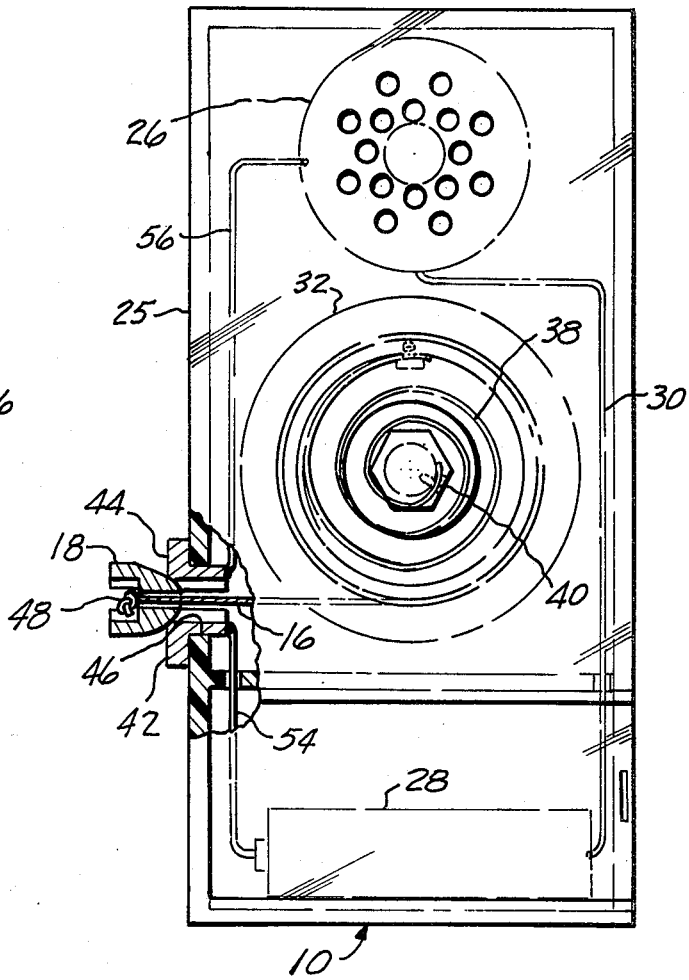
FIG. 2 is a front elevation of the intrusion alarm.

The intrusion alarm 10 is shown in greater detail in FIGS. 2 and 3. The intrusion alarm 10 includes a rectangular housing 25 which contains an alarm device 26 and a power source 28. One side of the power source 28 is connected by a wire 40 to the alarm device 26 which may be a buzzer, whistle or any other type of electrically operated alarm. Also mounted in the housing is a retractor 32 for retracting cord 16. The preferred form of a retractor is a spring-wound spool. The retractor 32 is mounted in the housing by a headed bolt 44 that forms an axle for the spool which is secured by a nut 36 on the opposite side of the housing 25.

The retractive force for the spool 32 is a wound spring 38 having an end 40 engaged in a transverse hole in the shank of the bolt 34. Rotation of the bolt 34 will effectively increase or decrease the winding force of the spiral spring 38 to increase or decrease the winding speed of the cord 16. To increase or decrease the winding force, the nut 36 is loosened, allowing the bolt 34 to be rotated to tighten or loosen the spiral spring 38. After the appropriate adjustment to the spiral spring 38 is accomplished, the nut 36 is tightened securely to clamp the bolt 34 against the exterior surfaces of the housing 24 and holding the adjustment. Pulling out the cord winds the spring tighter, and generates the retractive force.

Figure 4:
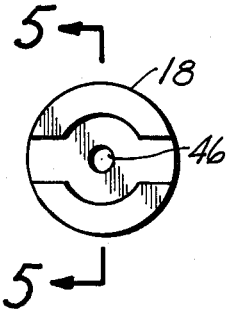
FIG. 4 is an end view of part of the releasible means used in the intrusion alarm of FIGS. 2 and 3.
Figure 5:
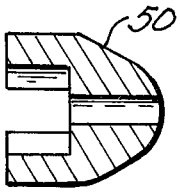
FIG. 5 is a sectional view taken at line 5—5 in FIG. 4.
Figure 6:
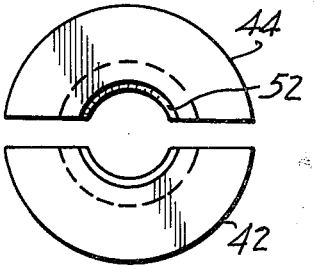
FIG. 6 is a view illustrating contacts for bridging a power source to an alarm in the intrusion alarm device of FIG. 2.

The plug 18 is adapted to affect connection of the power source 28 to the alarm device 26 by bridging contacts 42 and 44 that are secured in an aperture 46 in the housing 25. The details of the plug 18 and contacts 42 and 44 are shown more clearly in FIGS. 4, 5 and 6. The plug 18 has a central aperture 46 through which the cord 16 passes. A knot 48 is formed in the cord to hold the plug to the cord. As can be seen in FIG. 5, the plug 18 is generally rounded, and has a ballistic-shaped nose 50 to minimize the possibility of the plug's snagging on rugs or the like when the cord 16 is being retracted. When the plug 18 is fully retracted by the cord 16, it will engage and bridge contacts 42 and 44 by lodging in a socket 52 formed between the contacts. The plug is made of electrically-conductive material. The plug proivides a conductive bridge between wire 54 connected to the power source and wire 56 connected to the alarm 26 causing the alarm to go off when the cord is retracted for enough to pull the plug into the socket.

Thus in operation the intrusion alarm 10 is attached to the surface 12 and the cord 16 extended to span the entry 14. The releasible means in the form of the plug 18 is then attached to the plate or to surface 22 on the opposite side of the entry way by means of magnetic attraction of the plug to the surface or the metal plate. Upon unauthorized opening of the entry way 14, the door or window will contact the cord 16 dislodging (releasing) the plug 18 from the plate 20 causing the cord 16 to be retracted by the spiral spring 38. The plug 18 will then become lodged in the socket 52 formed by the contacts 42 and 44, connecting the power source 28 to the alarm device 26, and setting it off.

It is useful for the plug to have a substantial axial length, because then a pull on the cord has a lever-like effect in releasing the magnet. This is a more reliable release than simply sliding the magnet along the surface, although such an arrangement is within the scope of this invention.

Furthermore, the reliable means, and the conductive means to bridge the contacts, need not be the same body, although they preferably will be. Instead, a conductive member could be attached to the cord, spaced from the magnet, and the magnet might never reach the contacts. When the release means acts also as conductive means, it thereby performs two functions.

This invention is not to be limited to the embodiments shown in the drawings and described in the description which are given by way of example and not of limitation, but only in accordance with the scope of the appended claims.

I claim:

1. An intrusion alarm apparatus comprising: a retractible, flexible cord; releasible means attached to said cord for releasibly holding said cord in an extended position across an entry way; retractor means enabling said cord to be drawn out to said extended position, and to retract the cord when said releasible means is released; a source of power; electrically conductive metal plug means attached to said cord forming part of said release means when said cord is in said extended position; an alarm device; said release means adapted to be released when in a spanning relationship to said entry and there is entry through said entry way, said electrically conductive metal plug means forming a connection between said power source and said alarm device upon sufficient retraction of said cord, whereby said alarm device is actuated.

2. Apparatus according to claim 1 wherein said metal plug is a magnetized plug.

3. Apparatus according to claim 2 in which said releasible means further includes a magnetizable plate attachable to a surface.

4. Apparatus according to claim 2 wherein said metal plug is a generally rounded shape with a ballistic shaped nose to minimize snagging.

5. Apparatus according to claim 2 wherein said plug has a substantial dimension of length.

6. Apparatus according to claim 1 in which said retractor means comprises a spiral spring-loaded reel.

7. Apparatus according to claim 6 in which adjustment means is provided to adjust the retraction force exerted by said reel.

8. Apparatus according to claim 7 wherein said adjustment means comprises a bolt passing through said housing said bolt serving as an axle for said spool, and a nut.

9. Apparatus according to claim 8 wherein the end of said spiral spring engages a transverse hole in said bolt whereby rotation of said bolt adjusts the winding force of said spiral spring.

10. Apparatus according to claim 6 wherein said metal plug is a magnetized plug.

* * * * *